United States Patent [19]

Bell

[11] Patent Number: 4,986,673

[45] Date of Patent: Jan. 22, 1991

[54] RESEALABLE BAG ARRANGEMENT AND METHOD

[75] Inventor: Gary M. Bell, Crystal, Minn.

[73] Assignee: Kapak Corporation, St. Louis Park, Minn.

[21] Appl. No.: 458,145

[22] Filed: Dec. 28, 1989

[51] Int. Cl.[5] ..... B65D 33/02; B65D 33/25

[52] U.S. Cl. ..... 383/61; 383/63; 383/94; 206/610; 206/632

[58] Field of Search ..... 383/5, 61, 63, 94; 206/610, 613, 628, 629, 631, 632

[56] References Cited

U.S. PATENT DOCUMENTS

| | | | |
|---|---|---|---|
| 2,946,434 | 7/1960 | Brina | 206/629 X |
| 3,473,589 | 10/1969 | Götz | 383/61 X |
| 3,780,781 | 12/1973 | Uramoto | 206/629 X |
| 3,827,472 | 8/1974 | Uramoto | 383/61 X |
| 4,691,372 | 9/1987 | Van Erden | 383/63 |
| 4,709,533 | 12/1987 | Ausnit | 383/63 |
| 4,909,017 | 3/1990 | McMahon et al. | 383/63 X |

FOREIGN PATENT DOCUMENTS

| | | | |
|---|---|---|---|
| 1112446 | 8/1961 | Fed. Rep. of Germany | 383/63 |
| 1103173 | 9/1976 | Japan | 206/610 |
| 2117349 | 10/1983 | United Kingdom | 383/94 |

*Primary Examiner*—George E. Lowrance
*Assistant Examiner*—Jes F. Pascua
*Attorney, Agent, or Firm*—Merchant, Gould, Smith, Edell, Welter & Schmidt

[57] ABSTRACT

A receivable bag arrangement is provided. The bag arrangement includes an internal resealing arrangement utilizable to reseal the bag closed, after it has been used. In a typical arrangement, the resealing mechanism is enclosed within a heat sealed outer periphery. An arrangement is provided, to facilitate tearing open the arrangement by hand. This arrangement includes use of a reinforced tab region immediately adjacent a tear region having a gap portion. The tear region having greater perpencity to tear there across then the reinforced tab region.

21 Claims, 3 Drawing Sheets

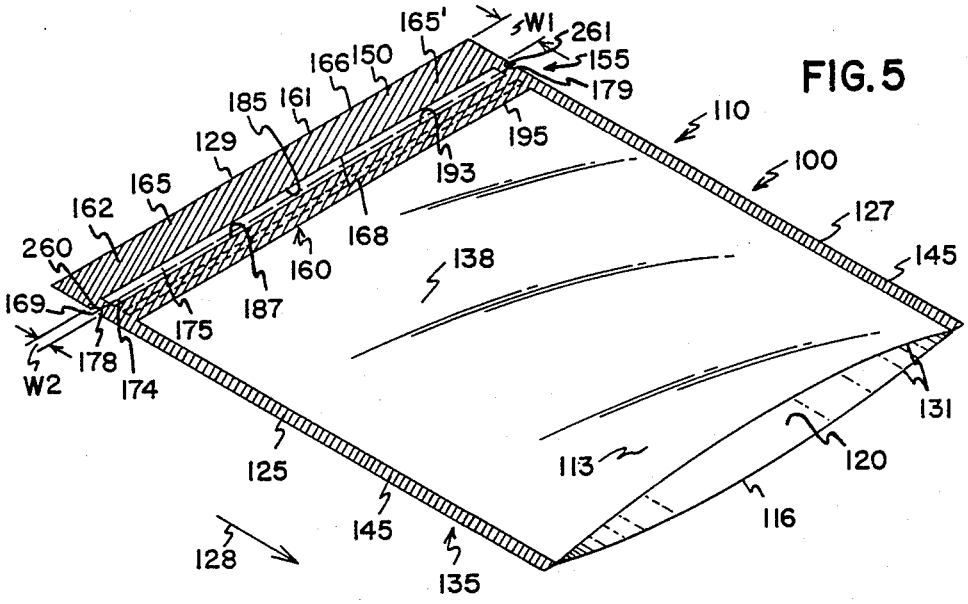
FIG. 5
FIG. 6
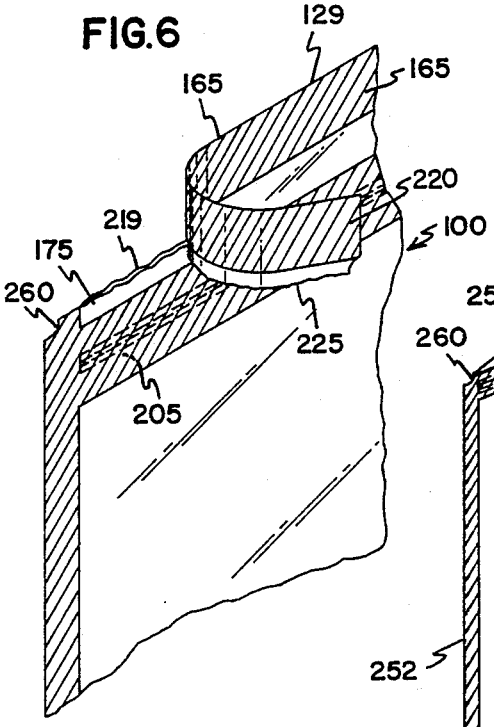
FIG. 7
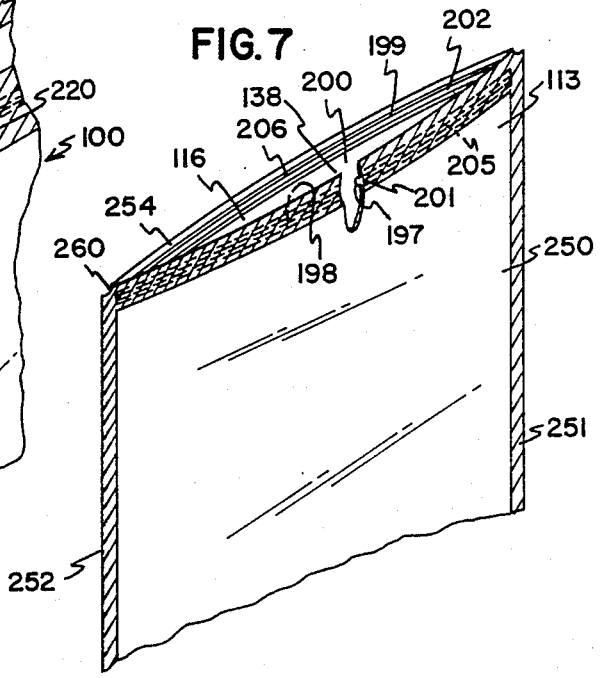

RESEALABLE BAG ARRANGEMENT AND METHOD

FIELD OF THE INVENTION

The present invention generally concerns resealable, flexible, bags, bag arrangements or pouches. In particular, the invention concerns an arrangement which in operation: can be closed and sealed about an object or objects contained within the bag structure; can be readily torn open for access to the enclosed item(s); and, can then be readily closed or resealed thereafter.

BACKGROUND OF THE INVENTION

A variety of items are marketed enclosed within flexible bags or bag constructions. Among other things, such constructions can generally operate to: protect the enclosed item(s); retain a plurality of pieces in close association with one another; facilitate storage and handling; facilitate access to a single stored unit, where a plurality of units might be stored; and/or to inhibit contamination of a stored item. A variety of bag designs have been used, for such purposes. One frequently used construction comprises first and second panels of materials, oriented in juxtaposed-relation to one another, and sealed along an outer peripheral area to one another, enclosing an object therebetween. In general, for such arrangements a partially constructed bag or pouch is generated from the first and second panels, by sealing them to one another along all but one side, to form an open pouch The object(s) are then inserted through the open side or end of the bag, and the last, open, edge is sealed closed, enclosing the item(s). Sometimes such arrangements are formed from first and second panels which are substantially rectangular, and thus the bag has four side edges which are sealed about a contained object or contained objects.

For some applications, it is desirable that the bag construction be reclosable, after it has been initially opened. That is, it is desirable that the arrangement be such that it can be readily reclosed after it has been opened for access to enclosed objects. It is, in many applications, further desirable that the bag be readily reopenable, after such a reclosing, to allow repeated access to enclosed objects. Such might be the case, for example, when it is intended that the bag be used to enclose a plurality of items, not necessarily to be removed from the bag for use all at the same time. Also, in some instances, an object might be used, and then returned to the bag for later storage and perhaps for re-use. It is thus apparent that in some applications it is desirable to provide a reclosable or resealable bag arrangement.

In general, if the bag arrangement comprises first and second panels sealed to one another along juxtaposed outer peripheries, the bag is generally opened by disrupting the peripheral seal; i.e. tearing the bag open. Such arrangements are not generally readily resealable, i.e., they are generally not resealable without the use of special equipment, adhesives and/or similar means of closure.

Resealable arrangements have been developed. In general, these have involved a mechanism oriented along an end or side of the bag, that can be closed in a zipper-like fashion. One such arrangement comprises a mechanism involving an elongate rib that can be selectively received within an associated channel or trough, formed between two flexible members or lips. Such arrangements are generally referred to herein as rib and trough closure arrangements, and one such arrangement is available, for example, under the trademark Ziploc TM from Dow Chemical Co.

The conventional zipper-like arrangements are not, in general, desirable for use in situations in which objects, as sold and/or distributed, are to be completely enclosed within a sealed bag. A reason for this is that closure arrangements such as the zipper-type arrangement are not readily sealed (during automated packaging) using mechanical or mass manufacturing techniques. Further, generating a lasting and secure seal along end portions of such arrangements can, in some instances, be difficult to accomplish. In general, zipper-like seals are better suited for short term use than they are as long term package seals.

Bag arrangements have been developed which, during the manufacturing process, are sealed such as by heating seals along the outer periphery, to enclose an object or objects therein, during manufacture and packaging; and, which include therein closure means comprising a rib and trough closure arrangement, oriented so that the rib and trough closure arrangement is actually enclosed within the initially sealed bag. During use, initial access to an enclosed item or items can be provided by tearing or cutting open an appropriate heat sealed seam or edge seal, and opening the internal closure arrangement. The internal closure arrangement (i.e. the rib and trough closure means) can then be used to reclose the bag, with allowance for later access. Two such conventional arrangements are shown in FIGS. 1–4.

FIGS. 1–3 depict a first such arrangement. Referring to FIG. 1, the reference numeral 1 designates a bag arrangement or construction comprising first and second opposite panel members 4 and 5. In FIG. 1, panel members 4 and 5 are shown in juxtaposed relation to one another, and sealed to one another along an outer peripheral area 7. In a typical application, members 4 and 5 are formed from a plastic film, such as a heal sealable polypropylene, polyethylene, polyester, plastic film or the like, and the seals along edges 7 are conventional heat seals. Conventional heat seals such as are found around the outer periphery 7 of arrangement 1 are usually about 0.2–0.3 inches wide.

For the arrangement shown in FIG. 1, bag construction 1 is generally rectangular in shape; that is, each of panels 4 and 5 is substantially rectangular. During a typical packaging operation, the panel members 4 and 5 are sealed to one another along three juxtaposed edges, with the remaining juxtaposed edges left not secured to one another, so that an object can be inserted into the bag. After the object or objects to be enclosed are positioned within the interior of the bag, the open edges are sealed to one another, enclosing the object or objects. For the arrangement shown in FIG. 1, typically the bag 1 would be constructed with end 12 left open, i.e., not sealed, so that an object or objects could be inserted therethrough during packaging.

Bag construction 1, FIG. 1, includes an enclosed resealable mechanism 15 therein. The resealable mechanism 15 of arrangement 1 is an enclosed zipper-type closure (i.e. rib and trough closure arrangement) comprising a first elongate rib member 16 adhered to one of members 4 and 5, and a second channel, receptacle, receiver or trough member 16′ operatively associated with an opposite one of panel members 4 and 5. Sealing, again, operates by engagement of the rib member 16 with the trough member 16', for example in the manner of engagement of the well-known Ziploc® arrangement.

For the arrangement 1, shown in FIG. 1, the resealable mechanism 15 extends between opposite side edges or sides 17 and 18, adjacent to, but spaced from, sealed end 19. That is, region 25 comprises a region wherein panels 4 and 5 are not adhered to one another. Regions 26 and 27 are regions whereat mechanism 15 is secured to panels 4 and 5. In a typical conventional arrangement region 25 would be about 0.4 to 0.5 inches wide, the width being the distance between the seal at 19 and a seam 27 by which mechanism 15 is mounted.

Operation of arrangement 1 will be understood by reference to FIGS. 2 and 3. In particular, in FIG. 2 a step of opening arrangement 1 is illustrated. Arrangement 1 is initially opened, for access to an enclosed object or objects, by removing end 19 from the construction 1, along a cut line extending through region 25. As noted above, in region 25, panels 4 and 5 are not adhered to one another. It is also noted that initially a tear through sealed outer periphery 7 is necessary. The tear is often initiated through use of a scissors or sharp edge such as a razor. Alternatively, outer periphery 7 may be notched adjacent to, and aligned with, region 25. Some users will generate a tear along a straight edge such as a table or desk edge, or a ruler. In any event, in typical operation edge 19 is stripped from the bag 1.

Once edge 19 has been stripped from the bag 1, it will be understood by reference to FIG. 2 that the portions of panels 4 and 5 extending beyond region 27 (above region 27 at 28 and 29 in FIG. 2) can be spread apart, allowing access to mechanism 15. Mechanism 15 can then be opened, for access to the interior of the bag 15. When desired, mechanism 15 can then be reclosed, to reclose the bag construction 1. Thus, the arrangement shown in FIGS. 1 and 2 does provide a construction: which is sealed (for example by heat seals along all edges) during the manufacturing or packing operation; which can be opened by stripping one of the seams or seals away from the arrangement; and, which can be readily reclosed.

A problem with conventional such arrangements, is that often it is often difficult or inconvenient for an operator to cut a straight line through region 25, and the operator may have difficulty stripping the entire edge 19 from the construction 1. This is a particular problem when the user does not have ready access to a pair of scissors or a straight edge, or does not have the patience or desire to use them. With respect to this, attention is directed to FIG. 3.

It has been observed by this Inventor that an inappropriate tear frequently occurs in conventional constructions such as arrangement 1, when edge 19 is stripped by hand, i.e., without use of a pair of scissors or a straight edge. At least one reason for this is that persons opening such bag constructions tend to grasp only a corner, such as corner 30, FIG. 2, and attempt to tear across the width of the bag with one single sweeping stroke. If the forces of the stroke do not provide for a substantially straight and carefully controlled tear line, the result is commonly a cross tear that is incomplete, as indicated at tear line 33 in FIG. 3. A result of the cross tear 33 is that end 19 is only partially opened. It is the inventor's observation that in many instances, with conventional arrangements, a mere hand tear cannot be readily effected with sufficient precision to avoid the problem.

Of course, if scissors, a razor or a straight edge were used to obtain the opening, the problem would be avoided. Unfortunately, scissors are not always readily available and/or the one seeking access to the interior of the bag construction 1 does not always wish to take the time to locate such tools. Opening such a conventional bag construction is therefore relatively inconvenient.

Another type of resealable bag arrangement is illustrated in FIG. 4. The arrangement 45 of FIG. 4 also generally comprises first and second panels 47 and 48 oriented in juxtaposed relation to one another, and sealed to one another along an outer periphery 50 thereof. As with the arrangement shown in FIGS. 1 and 2, generally the arrangement of FIG. 4 would be prepared with three sides, for example sides 52, 53 and 54, sealed closed, for example at seals or seams 52', 53' and 54', and with a fourth side, for example side 56, left open, for insertion of an object or objects to be enclosed within the arrangement 45. After the object is received within the arrangement 45 through end 56, end 56 is typically sealed closed, as indicated in FIG. 4 at seam 56'.

Arrangement 45 includes an internally received resealable mechanism 60, therein. For a typical such arrangement mechanism 60 is analogous to mechanism 15 of FIGS. 1–3. That is, it generally comprises a rib and trough closure arrangement 61 including an elongate rib attached to one of panel members 47 and 48, and a slot, receptacle or trough, appropriately adapted for a locking receipt of the rib member attached to an opposite one of panels 47 and 48. Arrangement 60 is shown attached within construction 45, at seams or seals 62 and 63.

The arrangement 45 of FIG. 4 differs from arrangement 1, FIGS. 1–3, in several significant manners. First, panels 48 and 47 are secured to one another completely through tab portion 67, from edge 53 to line 68. That is, there is no gap analogous to gap 25, FIG. 1, whereat panels 47 and 48 are separable from one another, in the entire region of tab 67. Thus, panels 47 and 48 reinforce one another, in strength, throughout the region defined between edge 53 and line 68, i.e. between edge 53 and mechanism 60. Secondly, line 68 is a score line. That is, line 68 represents a partial slit from side edge 54 across arrangement 45 to side edge 52. Thirdly, line 68 is terminated at indentations or notches 70 and 71.

Still referring to FIG. 4, edge 75 represents the edge of mechanism 60, adhered to or secured to panels 47 and 48. That is, tear line 68 is adjacent and generally parallel to mechanism 60. Alternately phrased, in arrangement 45, again, there is no space or field analogous to space 25 (between the zipper mechanism and edge 19), FIGS. 1–3, whereat panels 47 and 48 are not adhered to one another.

The score line 68 and notches 70 and 71 facilitate removal of tab 67 from assembly 45, permitting access to an interior of envelope 45, and mechanism 60. The score line 68, directs the cut in a relatively straight path between notches 70 and 71. The notches 70 and 71, weaken the relatively thick tab portion 67 to facilitate its removal from the arrangement 45. An undesired cut analogous to that of FIG. 3 is unlikely, since the score line, again, directs the cut completely between notches 70 and 71.

Arrangements such as bag arrangement 45, FIG. 4, however, are not completely acceptable for all applications. For example, in order to support the presence of a relatively deep and thus effective score line, it has generally been necessary that the materials used for panels 47 and 48 be relatively thick. Generally, arrangements such as that shown in FIG. 4 have been formed from relatively thick panels such that when secured together, a relatively thick, rigid, structure results. It is desirable, in many instances, to use a thinner, more lightweight and flexible, material for packaging panels.

Another of the problems with arrangements such as FIG. 4, is that during manufacture an appropriate score line must be placed. This can require special machinery and handling. It also provides a weakening, and thus point of potential flaw, in the material from which the arrangement is constructed.

What has been needed has been a bag arrangement: which comprises a pouch that can be fully sealed along all sides thereof to enclose an article or articles; which can be readily opened by hand, without the need for special tools and/or equipment, and which can then be readily resealed due to the presence therein of a resealable mechanism. It would be preferred that the arrangement include means facilitating opening, without the need for a score line therein. Preferably the means facilitating opening is such as to readily permit hand opening, without substantial risk of a undesirable cross or transverse tear, i.e. partial opening, in a manner analogous to that illustrated as undesirable in FIG. 3.

BRIEF DESCRIPTION OF THE DRAWINGS

FIG. 5 is a perspective view of a preferred embodiment of a bag arrangement according to the present invention, shown with one end open.

FIG. 6 is an enlarged fragmentary perspective view of the arrangement shown in FIG. 5, depicted partially opened.

FIG. 7 is a fragmentary perspective view of the arrangement depicted in FIG. 5, with the arrangement shown in an opened, but resealable, state; in FIG. 7 a portion being broken away to show internal detail.

SUMMARY OF THE INVENTION

Figure 1:
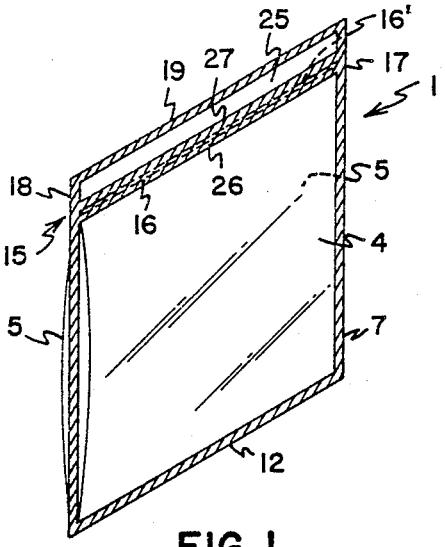
FIG. 1 PRIOR ART
FIG. 1 is a perspective view of a prior art bag arrangement.
Figure 2:
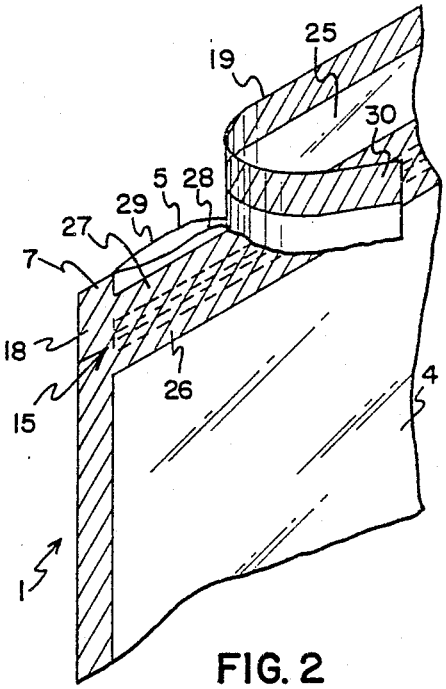
FIG. 2 PRIOR ART
FIG. 2 is an enlarged, fragmentary, perspective view of the prior art arrangement of FIG. 1, shown in a partially opened state.

According to the present invention, there is provided a bag arrangement comprising a panel arrangement including first and second opposed panels or panel portions, oriented to form an internal pouch or pouch region therebetween. The panels are secured to one another, along an outer periphery thereof, by securing means. The securing means defines a first closed end in the panel arrangement, whereat the first and second panel portions are secured to one another along end regions thereof. In some embodiments and instances the panels are sealed along the entire outer periphery, for example when the bag arrangement is sealed closed about an enclosed item. In other applications and instances a portion of the outer periphery may be open, for example to insert an item.

The bag arrangement includes a tab arrangement having a tab portion strippable from the resealable bag arrangement, along the first closed end, to provide access to the interior pouch thereof. The reinforced tab portion preferably is provided with sufficient strength so that it has a relatively low propensity for tearing thereacross. In preferred embodiments, the strength is provided by development within the tab portion of an extensive tab region wherein the first and second panels are secured to one another, for example by heat sealing. Also in preferred embodiments the low propensity to cross tear is provided by providing a relatively wide average width to the tab region, relative to other portions of the arrangement as described below.

The tab arrangement also includes a tear region, across which an opening tear is directed, during access to the interior of the resealable bag arrangement. The tab region preferably includes a gap portion and first and second opposite edge or side edge portions. In preferred embodiments, the side edge portions comprise part of an outer peripheral seal of the bag arrangement; and, the gap portion extends therebetween. Generally, the gap portion also extends along the reinforced tab portion, immediately adjacent thereto. Within the gap portion, the first and second panels are not secured to one another, and thus do not provide a reinforcing composite. Preferably, means are provided to ensure a relative high propensity for tear across the gap portion, relative to the reinforced tab portion, to ensure that as one strips the tab arrangement from the resealable bag arrangement, the tear tends to extend only across the tear region and not across the reinforced tab portion. In preferred arrangements, this is provided by having a gap portion of less width than the reinforced tab portion. In more preferred embodiments, the average width of the gap portion is no greater than about 75% of the average width of the tab region, more preferably no greater than about 40%, and most preferably about 5–25% of the average width of the tab region.

Also in preferred embodiments, tear notches are spaced from, but adjacent, opposite ends of the gap portion to facilitate opening. Further, in most preferred embodiments the gap portion is characterized by the absence of a score line thereacross.

In preferred arrangements both the tab region and the gap portion are generally rectangular in configuration. Thus, the average width of each is merely the measurement thereacross, measured in the appropriate direction.

Resealable bag arrangements according to the present invention include therein closure means extending across the panel arrangement immediately adjacent to the gap portion, and positioned on an opposite side thereof from the tab region. The closure means include means for selective opening and reclosing of an interior portion of the internal pouch region. Preferably, the closure means comprises a rib and trough closure arrangement.

Arrangements according to the present invention may be provided with an open end edge, for example opposite from the edge along which the reinforced tab portion is positioned. Arrangements with said open end edges generally comprise "blanks", i.e. empty pouches which may be operably positioned about an object or objects to be stored, and then sealed closed. The present invention at least encompasses within its scope: such "blanks"; completely sealed bag arrangements; and, arrangements wherein objects are enclosed within the bag and sealed therein.

In preferred arrangements, the average width of the tab region is at least about 0.7 inches, the width of the tab region generally being the dimension of the tab region along a line perpendicular to the intended tear line. More preferably, the average width of the tab region is between about 0.7 and 1.5 inches. Such a dimension facilitates a sufficiently reinforced tab region to provide the desired tear during operation. Such a region is considerably greater in width than a conventional heat seal, which typically has a width of only about 0.2–0.3 inches.

In preferred embodiments, the average width of the gap portion is between about 0.05 and 0.25 inches, the width of the gap portion generally being a dimension perpendicular to the intended tear line. Such a relatively narrow gap portion, facilitates a relatively straight tear during opening of the bag arrangement. In other words the arrangement includes means providing a substantially higher level of propensity for cross tear across the gap portion than the propensity for tear across the reinforced tab region; the propensity for tear across the gap region being sufficiently higher so that as a user tears (by hand) the reinforced tab region from the resealable bag arrangement, a tear line associated therewith extends through the gap portion and not the reinforced tab region.

In preferred embodiments, and to facilitate opening, tear notches are oriented on opposite ends of the gap portion. Such tear notches provide an initial starting point for directing a tear across the gap portion. Preferably, the tear notches are oriented such that they do not completely disrupt the outer peripheral seal of the bag arrangement.

Preferred bag constructions according to the present invention are generally rectangular, formed from first and second opposed rectangular panel portions or members. Preferably, the rectangular portions are formed from sheets of sealable films. Preferred materials include polyester laminated polyolefin films, more preferably metallized such films. Most preferably, each panel member is formed from such a film having a thickness of about 1.5–6.0 mil, i.e. 0.0015–0.006 inches. A preferred laminate is a polyester/polyethylene laminate. Most preferably, the material is 3–5 mil thick.

Preferably, the material from which the opposed panel portions are formed is a heat sealable material; and, the outer peripheral seals, and the securement of the panels to one another in the tab region, is generally by means of heat sealing. The enclosed closure means, in preferred embodiments the rib and trough closure mechanism, may be secured in place by a variety of means, including use of mounting flanges and adhesive and/or heat sealing.

DETAILED DESCRIPTION OF THE PREFERRED EMBODIMENT

As required, detailed embodiments of the present invention are disclosed herein. It is to be understood, however, that the disclosed embodiments are merely exemplary of the invention, which may be embodied in various forms. Therefore, the specific structural and functional details disclosed herein are not to be interpreted as limiting, but rather as a basis for the claims and as a representative basis for teaching one skilled in the art to variously employ the present invention in virtually any appropriately detailed system or structure.

The reference numeral 100, FIG. 5, generally designates a bag or pouch arrangement or construction according to the present invention. As used herein, the terms "bag", "pouch" and variants thereof are meant to refer to a flexible enclosure arrangement, i.e., a sack-like arrangement, inside of which an article or articles may be selectively enclosed. Typically, bags or pouches according to the present invention are used for the storage and protection of consumer items or materials. That is, items of interest are sealed within the bag or pouch, during a packaging operation, and the packaged items are then shipped to distributors, wholesalers, retailers and/or consumers. When desired, the bags are torn open to gain access to items therein.

As will be described in greater detail below, the bag arrangement includes internal means for releasably securing one panel to another, such that after the bag has been torn open, it can readily be securely closed again. In the preferred embodiment, such means for releasably securing the bag is such as allows the bag to be opened and closed a number of times.

As shown in FIG. 5, the resealable bag arrangement 100 includes a panel arrangement 110 wherein a first panel portion 113 and a second panel portion 116 are generally affixed to one another in a manner such that an object receiving recess 120 is defined therebetween. It is noted that in the preferred embodiment, shown in FIGS. 5–7, the panel arrangement 100 is generally rectangular with each panel portion or panel being of substantially similar dimensions. It is to be understood that the present invention is not, however, limited to rectangular arrangements; nor, is it limited to arrangements wherein one panel has identical dimensions to the second panel. Embodiments are envisioned wherein the panel arrangement and/or the resulting bag arrangement is not rectangular. Further, embodiments are contemplated wherein one panel is, for instance, larger than the second panel,. There is, of course, no requirement that the panel portions comprise independent sheets of material in order to obtain some advantage; however, although in the preferred embodiment described and shown they do. That is, arrangement 100 is preferably formed from two independent panel portions 113 and 116 adhered to one another.

The embodiment depicted in FIG. 5 is an arrangement wherein the first and second panels are generally rectangular and identical to one another. Each panel portion includes a first side edge region 125, and a second, opposite, side edge region 127 generally parallel to the first side edge region 125 and spaded therefrom. The side edge regions 125 and 127 extend substantially the entire length of the bag arrangement 100, i.e., along the direction of arrow 128.

The panel portions 113, 116 further include a first end edge region 129 and a second opposite end region 131. The end edge regions 129 and 131 are generally parallel to one another and are spaced apart and extend between the first and second side edge regions 125 and 127, respectively. In the preferred embodiment, the end edge regions 129 and 131 are generally perpendicular to the side edge regions 125 and 127. That is, again, the arrangement 100 is preferably rectangular.

Throughout the description of the preferred embodiment, the overall length of the bag arrangement 100 is referenced as being parallel to the first and second side edge regions 125 and 127. Similarly, the width of the overall bag arrangement 100 is referenced as being generally parallel to the end edge regions 129 and 131 of the bag 100. It is to be understood that the invention presents no limitations on which of the overall length and width dimensions is greater. That is, bag arrangements 100 according to the present invention are contemplated: wherein the bag 100 has a greater dimension in the direction parallel to the end edge regions than in the direction parallel to the side edge regions; wherein the bag arrangement 100 has a lesser dimension in the direction parallel to the end edge regions, then in the direction parallel to the side edge regions; and, wherein the dimensions are the same.

For the arrangement shown in FIG. 5, the first panel portion 113 and the second panel portion 116 are affixed or secured to one another at or along respective peripheral regions 135 but are independent (separable) of one another over a substantial portion of their internal regions 138. Typically, panel portions 113 and 116 are secured to one another along three sides prior to filling the bag arrangement 100. FIG. 5 depicts this arrangement. After an article or articles to be enclosed are inserted into the bag arrangement 100, a fourth or open side of the bag 100 is sealed. This operation will be further described below.

In the preferred embodiment shown in FIG. 5, the first and second side edge regions 125 and 127 are secured to one another by heat seals 145, which firmly secure first panel portion 113 to second panel portion 116. For the arrangement of FIG. 5 the "fourth" or "open" side for filling the bag arrangement 100, is end edge 131. Heat seals 145 may be conventional heat seals, as typically used in conventional bag arrangements, i.e. seals about 0.2–0.3 inches wide.

The first end region 129 extends between the side edge regions 125 and 127, as noted above. The end region 129 includes securing means 150 sealing the panel portions 113 and 116 together. Further, the first end region 129 includes means 155 for tearing the end region 129 away from the bag arrangement 100. Adjacent end region 129 is means 160, for resealably securing and sealing the panels 113 and 116 to one another.

In greater detail, the first end region 129 comprises a tab arrangement 162, which includes generally two portions. The first portion is a reinforced tab portion 165, which in the preferred embodiment is generally proximate an outermost edge or periphery 161 of the end region 129. In and substantially completely across the tab portion 165, is a reinforced tab region 165' in which panel portions 113 and 116 are secured to one another, for example by heat sealing. That is, the bag arrangement 100 is reinforced in portion 165, by having the panel portions 113 and 116 attached to one another. Tab region 165' has an average width W1, as measured between its outermost edge 166 (for the embodiment shown, outermost edge 166 of tab region 165' being coextensive with edge 161) and a second opposite edge 168 generally parallel to and spaced apart from the outermost edge 166. For the preferred embodiment shown, average width W1 is measured along a direction generally perpendicular to a preferred line of tear 169 through arrangement 100 during opening. For the preferred embodiment shown, tab region 165' is generally rectangular, so its average width W1 is merely its width across at any location, measured in the appropriate direction. That is, its width is constant.

Adjacent the tab region 165', is tear region 174 including a gap portion 175. In gap portion 175, the panel portions 113 and 116 are generally independent of one another; i.e. not secured or adhered to one another. In preferred embodiments panels 113 and 116 are secured to one another at opposite side edge portions 178 and 179 of the tear region 174. The gap portion 175 extends across arrangement 100 between tear region side edge portions 178 and 179. Preferably, edge portions 178 and 179 comprise portions of sealed side edges 125 and 127, respectively. Also, preferably edge portions 178 and 179 do not have any greater width (width being measured as distance of extension from a side edge) than a side edge seam or seal.

For the preferred embodiment, the gap portion 175 has an average width W2 measured between a first edge 185 and a second edge 187. Second edge 187 is generally parallel to and spaced apart from first edge 185. First edge 185 is generally coextensive with edge 168 of reinforced tab portion 165. Alternatively stated, the average width W2 is generally measured across gap portion 175 in a direction perpendicular to a preferred tear line 169, for stripping tab portion 165 from arrangement 100. In the embodiment shown gap portion 175 is generally rectangular, so its average width W2 is merely its width as measured thereacross, in the appropriate direction. That is, its width is constant.

The bag arrangement 100 also includes closure means 160. The closure means 160 extends across arrangement 100 between the gap portion 175 and the internal pouch or region 138 of the bag arrangement 100. Closure means 160 includes a first edge 193 generally adjacent to or commensurate with edge 187 and a second edge 195 proximate internal region 138. Referring to FIG. 7, closure means 160 includes a first engagement member 197 affixed to an inside 198 of first panel portion 113 and extending toward an inside of the bag arrangement 100, and a second engagement member 199 affixed to the inside 200 of the second panel portion 116 and extending toward an inside of the bag arrangement 100. First and second engagement members 197 and 199 are adapted to engage one another, in a sealing arrangement which allows convenient opening and closing of the seal and preferably provides for a secure seal even after repeated opening and closing.

In the preferred embodiment, the engagement means is a zipper-type rib and trough arrangement. Thus, one of the engagement members is an elongate rib member and the other engagement member is an elongate trough adapted to receive the rib member. Referring to FIG. 7, for the embodiment shown the first engagement member 197 is a rib member 201 and the second engagement member 199 is a trough member 202. In FIG. 7 a portion is broken away so that members 201 and 202 are both viewable.

As incorporated into the preferred closure means 160 of bag arrangement 100 according to the present invention and shown in FIGS. 5–7, each engagement member 197 and 199 is disposed in a plastic strip portion 205 and 206 respectively, which are secured to respective panel portions 113 and 116. In other words, in the preferred embodiment, a first plastic strip portion 205 is provided including elongate rib member 201 thereon and plastic strip portion 205 is affixed to an interior side 198 of first panel portion 113. Analogously, a second plastic strip 206 includes elongate trough member 202 and is affixed to the interior side 200 of second panel portion 116. Engagement members 197 and 199 extend toward the interior 138 of the bag. Preferably, strip portions 205 and 206 are secured by means of heat sealing or adhesive, to their respective panel portions 113 and 116.

Figure 8:
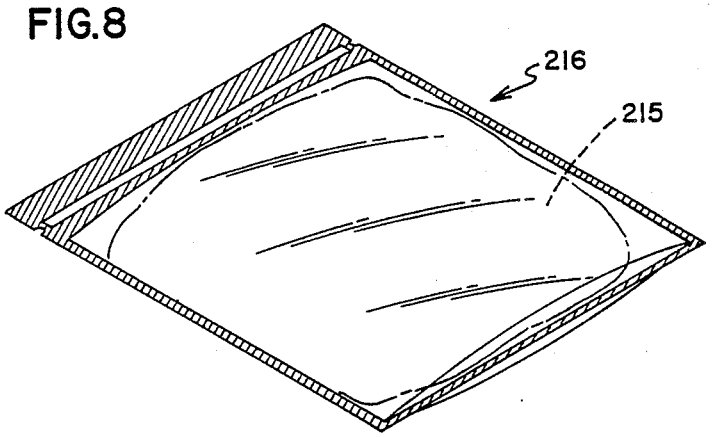
FIG. 8 is a perspective view of the bag of FIG. 5, shown sealed closed about an enclosed item.

In typical use, the bag arrangement 100 is provide as illustrated in FIG. 5, with three of the four edge regions sealed, and with a fourth edge region open to receive an article or articles. After receiving an object, typically the fourth edge region (for the depicted embodiment region 131) is sealed closed, so that the packaged article(s) will thereby be enclosed within the bag arrangement 100. This is illustrated in FIG. 8, wherein article 215 is shown within closed bag arrangement 216; bag arrangement 206 being the arrangement 100 of FIG. 5 closed about article 215.

Figure 3:
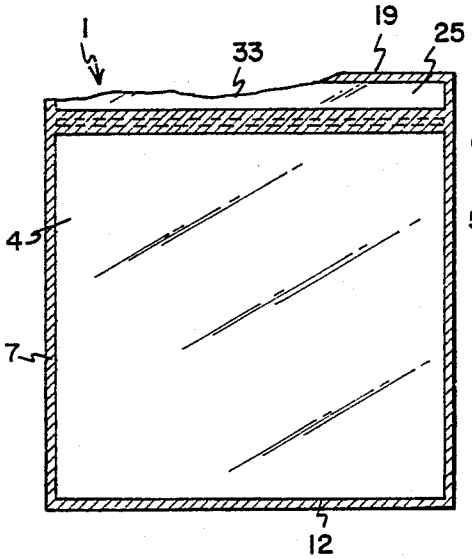
FIG. 3 PRIOR ART
FIG. 3 is a plan view of the arrangement in FIG. 1, shown after a step of opening.
Figure 4:
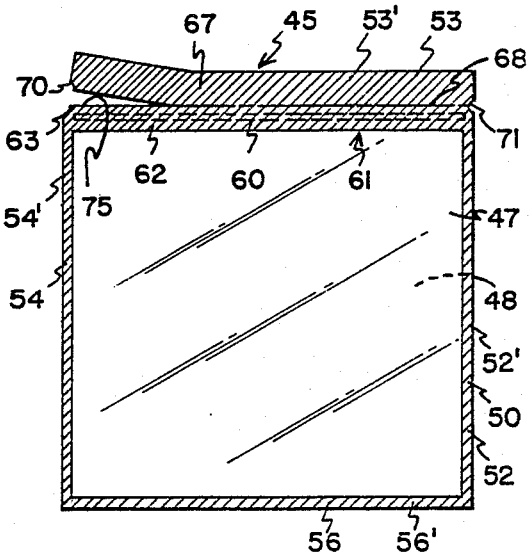
FIG. 4 PRIOR ART
FIG. 4 is a plan view of a second prior art arrangement, shown partially open.

When the packaged article reaches the ultimate user, the user will selectively open the bag, generally at the first end edge region 129, by tearing sealed tab portion 165 off of the bag as illustrated in FIG. 6, along tear line 219. More specifically, the user will typically grasp a corner such a corner 220 of the sealed tab portion 165 and tear across the width of the bag; i.e. in a direction generally parallel to the first end region 129. The tear line 219, i.e., tear 225, is propagated along the length of, and within, the gap portion 175, since at the gap portion 175 the panel portions 113 and 116 are not reinforced by securement to one another, and generally tear more easily than the adjacent closure means 160 and the reinforced tab portion 165. Undesirable cross tears, or transverse tears, which would result in tear lines (and incomplete openings) such as illustrated for the prior art arrangement shown in FIG. 3 are not likely to occur since reinforced tab portion 165 is stronger and has a significantly lower propensity to tear than gap portion 175. For the embodiment shown, means facilitating this include provision of a gap portion 175 with an average width W2 that is less than an average width W1 of the associated reinforced tab portion. More preferably W2 is no more than about 75% of W1. Even more preferably, W2 is no greater than about 40% of W1, and most preferably it is about 5 to 25% of W1. Also, preferably W1 is at least about 0.7 inches wide, and most preferably it is between about 0.7 and 1.5 inches wide, so it is relatively strong. This provides for a sufficiently reinforced tab of convenient size for gripping and stripping. Also, most preferably W2 about 0.05 to 0.25 inches, ensuring a relatively narrow gap portion, to help channel tear line 219 in a generally straight course across arrangement 100.

After the user has propagated tear 225 across the entire width of the bag arrangement 100, i.e. after tab portion 165 is stripped away from the remainder of the bag arrangement 100, a pouch 250, FIG.7, remains that is sealed on three edge regions only two edges 251, and 252 viewable in FIG. 7 and which is releasably sealed at the remaining edge, edge 254, FIG. 7, by the closure means 160 (In FIG. 7 edge 254 is depicted open). The closure means 160 is adapted to be selectively opened and closed, repeatedly, to take articles from, and insert articles into, the bag arrangement 100, as desired.

It will be understood that in preferred embodiments the gap portion 175 is characterized by the lack of a score line thereacross. This is particularly convenient, since it allows for the materials of panel portions 113 and 116 to retain their structural integrity, and it is relatively simple to construct. The directing of tear line 219 across bag arrangement 100 may be facilitated through the provision of first and second opposite notches 260, 261, respectively, in portions 178 and 179. Preferably, the notches are oriented in side edge seals 145 along edges 125 and 127, and are adjacent to but spaced from gap portion 175. In this manner, they facilitate selective disruption of the edge seals for opening.

Bag arrangements according to the present invention may be manufactured from a variety of materials. It is particularly advantageous, however, that they be constructed from relatively thin, strong material such as polyester film, and particularly metallized polyester film. Preferred embodiments which are particularly useful, and include advantages according to the present invention, may be constructed wherein the first and second panel portions comprise first and second sheets of metallized polyester polyolefin laminate film each having a thickness within a range of about 1.5–6.0 mil more preferably about 3–5 mil. Preferably, heat sealable metallized polyester/polyolefin film is utilized so that the means of securing the panel portions to one another, and securing the closure means to the panel portions, is by heat seals without the need for additional adhesive.

One preferred metallized polyester film material utilizable to form bag arrangements according to the present invention is available from Flexicon, Inc. under the designation laminated metallized polyester. It comprises a 48 gauge ICI #443 metallized polyethylene material metallized to 2–4% light transmission. Another material that may be utilized is Heat Sealable Polyester Film #48, a non-metalized film available from 3M under the trademark SCOTCHPAK ®. Such material has a tensile strength of about 9 pounds per inch width, 100% elongation, burst strength about 50 pounds per square inch, edge tear strength about 1,000 grams and an Elmendorf tear strength of 80+ grams. The suggested heat seal conditions for such an arrangement are about 300°–400° F. for 0.2–2.0 seconds at 20–60 psi.

It will be understood that bag arrangements according to the present invention may be provided with a variety of outer dimensions, depending upon the intended use.

It is to be understood that while certain embodiments of the present invention have been illustrated and described, it is not be limited to the specific forms or arrangements herein described and shown.

What is claimed is:

1. A resealable bag arrangement comprising:

(a) a panel arrangement including first and second opposed panel portions, each of said panel portions including a first end region and having an outer periphery;

(b) securing means securing said first and second panel portions to one another along said outer peripheries to a sufficient extent to form an internal pouch region; said securing means defining a first closed end in said panel arrangement whereat said first and second panel portions are secured to one another along said first end regions;

(c) a tab arrangement comprising:

(i) a reinforced tab portion extending along said panel arrangement first end region; and, including said first closed end and having a tab region extending thereacross; said first and second panel portions being secured to one another within said tab region; said tab region having a first average width of extension from said first closed end; said reinforced tab portion being reinforced by said first and second panel portions being secured to one another therein and said reinforced tab portion being characterized by the absence of reinforcing structure other than said first and second panel portions thereat;

(ii) a tear region having a gap portion and first and second opposite side edge portions: said gap portion extending along and adjacent said tab region; said gap portion being bordered along opposite sides by said first and second side edge portions; said first and second panel portions being secured to one another within said first and second side edge portions; said first and second panel portions not being secured to one another in said gap portion; and, said gap portion having a second average width of extension from said tab region, said gap region second average width of extension being smaller than said tab region first average width of extension; and, (d) closure means extending across said panel arrangement immediately adjacent to said gap portion and positioned on an opposite side thereof from said tab region; said closure means including means for selecting opening and closing of an interior portion of said internal pouch region.

2. A bag arrangement according to claim 1 wherein:

(a) said panel arrangement defines a second pouch end opposite to said first closed end;

(b) said first and second panel portions are secured to one another at said second pouch end to close same.

3. A bag arrangement according to claim 1 wherein said gap portion second average width of extension is no greater than about 75% of said tab region first average width of extension.

4. A bag arrangement according to claim 3 wherein said tab region first average width of extension is at least about 0.7 inches.

5. A bag arrangement according to claim 3 wherein said tab region first average width of extension is between about 0.7 and 1.5 inches.

6. A bag arrangement according to claim 1 wherein said gap portion second average width of extension is no greater than about 40% of said tab region first average width of extension.

7. A bag arrangement according to claim 1 wherein said gap portion second average width of extension is between about 5–25% of said tab region first average width of extension.

8. A bag arrangement according to claim 7 wherein said gap portion second average width of extension is between about 0.05 and 0.25 inches.

9. A bag arrangement according to claim 1 wherein each of said tear region side edge portions includes a tear notch therein, said side edge portion tear notches being oriented to facilitate a tear across said tear region, to separate said tab portion from a remainder of said bag arrangement including said closure means.

10. A bag arrangement according to claim 1 wherein:

(a) said first and second opposed panel portions comprise first and second sheets of heat sealable metallized polyester/polyolefin laminate film, respectively; and, (b) said first and second sheets of heat sealable metallized polyester/polyolefin laminate film are heat sealed to one another: along said secured outer peripheries of said panel portions; within said tab region; and, within said tear region side edge portions.

11. A bag arrangement according to claim 10 wherein each of said first and second sheets of film has a thickness of about 1.5–6.0 mil.

12. A bag arrangement according to claim 10 wherein:

(a) each of said first and second sheets of film has a thickness of about 3–5 mil;

(b) said gap portion second average width of extension is between about 5–25% of said tab region first average width of extension; and, (c) said gap portion second average width of extension is about 0.05 and 0.25 inches.

13. A bag arrangement according to claim 12 wherein:

(a) each of said first and second sheets of film is generally rectangular;

(b) said panel arrangement defines a bag arrangement having opposite side edges; and (c) said closure means comprises a rib and trough closure arrangement extending substantially between said panel arrangement side edges.

14. A resealable bag arrangement comprising:

(a) a panel arrangement comprising first and second opposed panel portions, each of said panel portions comprising a rectangular sheet of heat sealable polyester film having a thickness of about 1.5–6.0 mil;

(i) said opposed panel portions defining a rectangular panel arrangement having an outer periphery defining first and second opposite side edges and first and second opposite end regions;

(ii) said opposed panel portions being heat sealed to one another along said panel arrangement opposite side edges;

(b) a tab arrangement comprising:

(i) a reinforced tab portion: extending along said panel arrangement first end region; and, including a tab region, extending between said panel arrangement side edges, wherein said panel arrangement side edges, wherein said first and second panel portions are heat sealed to one another; said tab portion having a first average width of extension, in a direction generally parallel to said panel arrangement side edges; said reinforced tab region being reinforced by securement of said panel portions to one another therein; and, said reinforced tab portion being characterized by the absence of reinforcing structure, other than said panel portions, therein;

(ii) a tear region having a gap portion: said gap portion extending along and adjacent said tab region; said gap portion being bordered on opposite sides by said heat seals along said panel arrangement side edges; said opposed panel portions being unsecured to one another within said gap portion; and, said gap portion having a second average width of extension, in a direction parallel to said panel arrangement side edges, which is no greater than about 40% of said tab region first average width of extension, and which is no greater than about 0.05 to 0.25 inches; and, (c) closure means comprising a rib and trough closure arrangement oriented adjacent said gap portion and extending along a side thereof opposite to said tab region; said rib and trough arrangement extending between opposite seals along said panel arrangement side edges.

15. An arrangement according to claim 14 including a heat seal oriented to close said panel arrangement second end region.

16. An arrangement according to claim 14 wherein:

(a) each of said sheets of film is a sheet of metallized polyester film; and (b) said panel arrangement includes first and second tear notches therein; said tear notches being: oriented in opposite portions of said heat seals along said panel arrangement side edges; adjacent to, but spaced from, said gap portion; and, oriented to direct a tear line formed therebetween, during use, across said gap portion.

17. A resealable bag arrangement comprising:

(a) a panel arrangement including first and second opposed panel portions, each of said panel portions including a first end region and having an outer periphery;

(b) securing means securing said first and second panel portions to one another along said outer peripheries to a sufficient extent to form an internal pouch region; said securing means defining a first closed end in said panel arrangement whereat said first and second panel portions are secured to one another along said first end edge region;

(c) a tab arrangement comprising:

(i) a reinforced tab region extending along said first closed end; said first and second panel portions being secured to one another within said reinforced tab region; said reinforced tab region having a first level of propensity to tear thereacross; said reinforced tab region being reinforced by securement of said panel portions to one another therein; and, said reinforced tab portion being characterized by the absence therein of reinforcing structure other than said panel portions;

(ii) a tear region having a gap portion and first and second opposite side edge portions: said gap portion extending along and adjacent said tab region; said gap portion being bordered on opposite sides by said first and second side portions; said first and second panel portions being secured to one another with said first and second side edge portions; said first and second panel portions not being secured to one another within said gap portion; said gap portion being further characterized by the absence of a score line thereacross;

(d) closure means extending across said panel arrangement immediately adjacent to said gap portion and positioned on an opposite side thereof from said tab region; said closure means including means for selective opening and closing of an internal portion of said internal pouch region; and (e) means providing a substantially higher second level of propensity for tear across said gap region than said first level of propensity for tear across said reinforced tab region; said second level of propensity being sufficiently higher than said first level of propensity so that a user tears said reinforced tab region from said resealable bag arrangement, without a cutting device or straight edge, a tear line associated therewith extends through said gap portion and not said reinforced tab region.

18. A bag arrangement according to claim 17 wherein:

(a) said panel arrangement defines a second pouch end opposite to said first closed end; and, (b) said first and second panel portions are secured to one another at said second pouch end to close same.

19. A bag arrangement according to claim 17 wherein each of said tear region side edge portions includes a tear notch therein, said side edge portion tear notches being oriented to facilitate a tear across said tear region, to separate said tab portion from a portion of said bag arrangement including said closure means.

20. A bag arrangement according to claim 17 wherein:

(a) said first and second opposed panel portions comprise first and second sheets of heat sealable metallized polyester/polyolefin laminate film, respectively; and (b) said first and second sheets of heat sealable metallized polyester/polyolefin laminate film are heat sealed to one another: along said outer periphery of said panel arrangement; within said tab region; and, within said tear region side edge portions.

21. A bag arrangement according to claim 20 wherein each of said first and second sheets of film has a thickness of about 1.5–6.0 mil.

* * * * *

UNITED STATES PATENT AND TRADEMARK OFFICE

CERTIFICATE OF CORRECTION

PATENT NO. : 4,986,673

DATED : January 22, 1991

INVENTOR(S) : Gary M. Bell

It is certified that error appears in the above-identified patent and that said Letters Patent is hereby corrected as shown below:

Column 8, line 52 "spaded" should read --spaced--.

Column 11, line 3 "provide" should read -- provided--.

Column 14, lines 39 and 40 delete "wherein said panel arrangement side edges," after the word "edges".

Signed and Sealed this

Twenty-first Day of September, 1993

Bruce Lehman

*Attest:*

BRUCE LEHMAN

*Attesting Officer*

*Commissioner of Patents and Trademarks*